US005704463A

United States Patent [19]

Garcia Morales

[11] Patent Number: 5,704,463

[45] Date of Patent: Jan. 6, 1998

[54] COIN RETURNING MECHANISM, APPLICABLE TO PUBLIC MODULAR TELEPHONES

[75] Inventor: Jose Manuel Garcia Morales, Madrid, Spain

[73] Assignee: Telefonica De Espana, S.A., Madrid, Spain

[21] Appl. No.: 565,234

[22] Filed: Nov. 30, 1995

[30] Foreign Application Priority Data

Dec. 9, 1994 [ES] Spain ..... 9403162

[51] Int. Cl.[6] ..... G07F 9/04

[52] U.S. Cl. ..... 194/345; 194/351; 232/58

[58] Field of Search ..... 194/345, 351; 232/55, 57, 57.5, 58

[56] References Cited

U.S. PATENT DOCUMENTS 992,258 5/1911 Rowse ..... 194/351 X 1,949,541 3/1934 Hartman ..... 194/351 X

FOREIGN PATENT DOCUMENTS 2122402 1/1984 United Kingdom ..... 194/351

*Primary Examiner*—F. J. Bartuska

*Attorney, Agent, or Firm*—Reid & Priest L.L.P.

[57] ABSTRACT

A coin return mechanism for public telephones has a coin box 1 with an access door 13 and a cam 15. The access door 13 and cam 15 are mounted on a shaft 14 that turns when door 13 is pushed, and return to the their resting position when the door is no longer pushed. A pusher 3 includes a square section rod 35 having an angular deformation of 70° at one end, and having a recess for housing a wheel 33 that rotates atop cam 15. The other end of the square section rod 35 has a drilled hole for receiving a shaft that supports a forked prismatic part 34 that turns about the shaft. The two arms of the forked part 34 and the rod 35 have drilled holes through which the shaft passes. A spring 36 situated on the shaft is fastened to the an end of the forked prismatic part 34 and to the rod 35. When the access door 13 is opened, cam 15 moves and causes pusher 3 to move upward and cause a cylindrical pin 67 in a coin inserting mechanism 4 to block a coin insertion slot 46.

5 Claims, 5 Drawing Sheets

COIN RETURNING MECHANISM, APPLICABLE TO PUBLIC MODULAR TELEPHONES

BACKGROUND OF THE INVENTION

The present specification refers to a Model of Utility concerning to a coin returning mechanism, applicable to public modular telephones, the purpose of which is to provide a coin admission and returned coin reception system, as well as to plug the admission ramp when a user accedes to a coin returning box, in order to impede the coins to be inserted into it, this coin returning mechanism being able to be used in machines that, same as the public modular telephones, are coin operated.

FIELD OF THE INVENTION

This invention will find application in the industry devoted to the manufacture of public modular telephones and machines which are coin operated

RELATED ART

There is known, at present, the existence of a plurality of coin returning mechanisms, which are installed, among other apparatus, in public telephones and other types of machines, that, same as the public telephones, are coin operated.

It has been checked that these mechanisms allowing the coins to be returned, both in telephones and machines which are coin operated, do not impede, in an efficient manner, an access inside the public telephones or machines where they are installed, through coin returning boxes, and that, in turn, they do not stop either an access of the coins to the telephone or machine, while the returned coins are recovered from the returning box, which makes easy the existence of frauds of different kinds.

An evident solution to the above-mentioned problems, would be to provide a coin returning mechanism, which incorporated in a—public telephone or a machine which are coin operated, would impede access inside these apparatus wherein they are installed, foreign bodies through the returning box, and, in turn, to stop the coin access to the telephone or machine, while the returned coins are recovered from said box.

Nevertheless, until now, nothing is known by the Applicant about the existence of a coin returning mechanism fitted with features considered as suitable.

SUMMARY OF THE INVENTION

The coin returning mechanism, applicable to public modular telephones of the invention, constitutes, per se, an evident solution to the present problem on this matter, since starting from it, it is possible to make use of the advantages as pointed out as suitable, its incorporation allowing not only to be used in true public telephones, but also in several different machines fitted with a coin returning mechanism which are operated by previously inserting coins into their coin boxes.

In a more definite way, the coin returning mechanism, applicable to public modular telephones of the invention, is constituted starting from the following parts or elements, namely:

A box to receive returned coins.

A pusher.

A coin inserting module, fitted with a plug.

The box for receiving coins is composed, in turn, starting from the following elements or parts; namely:

A front frame.

A coin receptacle.

A door.

A shaft.

A cam.

The front frame is formed by a rectangular prism of limited—height, and the base of this prism, as seen from outside the machine, exhibits a rectangular cavity, centered in height and displaced until the right end, which is closed by a door acceding inside the coin receptacle, the perimeter of this base being partially rounded.

Inside the machine, where it is installed, the front frame has a perimetric recess to be adapted to the cavity in said machine.

Also, the front frame has centered in height but displaced toward the left side, a rectangular hollow of lesser height than the perimetric recess, and having a width which is greater than the door void.

Likewise, the front frame has two groups of four studs, that most external for fixing the own front frame to the element on which it is fitted, while the stud located at the most internal zone is for fixing the coin receptacle to the front frame.

The coin receptacle is configured like a pan adopting an irregular shape, fully open at its front and upper side, its specific function being to house the coins returned by the telephone or machine where it is installed, in order that the users can recover the coins.

The bottom and the rear wall of said coin receptacle are formed by two segments having a circular surface, being adapted to the—door shape, and count on an open pentagonal profiled surface, acting as a pan for retaining the coins resulting from the returning, so allowing the door to be fully opened, in a tilting way, not being obstructed by the coins returned.

The rear wall is completed by means of a ramp formed by two—planes, one of them, particularly the front one, bonded to the—circular surface segment acting for conducting the returned coins to the pan, and other rear plane being appreciably shorter.

The side walls of the coins receptacle are configured like two even surfaces, parallel and equal, having two recesses at the—front side, the recess located at the front zone serving for adapting the coin receptacle in the hollow cut at the front frame, and the other recess, having larger dimensions, being specifically designed for allowing the adaptation to the inner configuration of the telephone or machine where it is installed.

On the step or length between the two above-mentioned recesses, the side walls have cylindrical drilled holes confronted, these drilled holes serving for allowing the shaft supporting and tilting the door to be positioned.

Fixed to the side walls, in the direction toward same, the invention has provided a part adopting a "U" configuration, on which its arms have a width which is appreciably larger than the part uniting them, having two cylindrical drilled holes, each of which is coincidental with the group of the above mentioned for studs, which are located, such as it has been said, on the interior of the front frame, and having the specific function of fixing to this front frame the coin receptacle, tieing the walls of the telephone or machine where the assembly is installed, between said "U" shaped part and the front frame.

The door of the coin returning box is constituted, approximately, by a cylindrical hollow segment, which is formed by a curved part of metal sheet defining the main body of the door, and two side metal sheets closing the assembly by two sides, having square section drill holes, which are adjacent to the cylindrical surface where the shaft is located.

At the cylindrical sector portion next to the shaft, there are two recesses for fitting the box door in the front frame or panel.

The side surfaces of the box door fit to the lateral sides of the void of the front frame, and the cylindrical surface of same fit to the lower side of said void and the curved surface constituting the bottom of the coin receptacle in the rest position.

When the door is tilted inwards, in order to accuse to the returned coins, said cylindrical surface of the door is coincidental with the cylindrical surface of the rear wall of the coin box.

The cylindrical surface arc is long enough for said surface to contact the cylindrical surface of the rear wall of the coin receptable before breaking the contact with the cylindrical surface of the bottom thereof, therewith the access inside the telephone, where the assembly is installed, is impeding all the time.

The shaft is formed by a square section metal rod, the diagonal of which is equal to the diameter of the cylindrical drill holes existing at the side walls of the coin receptacle, and the side of which is equal to the drill holes existing at the cover and cam, where it fits for supporting and rotating the latter jointly with it.

The shaft has, at both ends, a threated portion to be fitted to the assembly by means of nuts.

The cam is formed by a metal part having an adequate configuration, which moves jointly with the cover, since it is mounted on an end of same shaft, out of the coin receptacle, acting together with the pusher through a small wheel turning of the surface of—said cam.

The pusher is constituted, in turn, starting from the following elements, namely:

A bracket for the pusher.

A true pusher.

The pusher bracket is formed by a rectangular metallic part, having, at one of the sides, two wing lenths having both drill holes, and having, at the opposite side, a "U" shaped fold, whereby the pusher slides.

The pusher bracket is fixed to the interior of the telephone by means of two of the studs fixing the protecting plate of the display and keyboard.

The true pusher is constituted by a square section rod, one of the ends of which is folded forming a 70° angle and having a recess for housing a small wheel fixed to the rod by means of a special—screw acting as a turning axle.

At the other end, the rod has a drill hole for receiving a shaft supporting a prismatic part having a fork shape, turning around it.

The fork shaped prismatic part, seen in profile, ends like a curve at one of its ends, and has both transverse drill holes at the opposite end, whereby the shaft passes, through the two arms of the fork and rod.

The function of the prismatic part is to push the plug to impede the coins to enter through the groove when the rod is vertically displaced upward upon being driven by the cam, when opening the coin returning box to accede inside said box.

In addition, the pushing assembly has a spring located around the shaft, fixed to the rod and the on which it exerts a pressure, the function of which is to maintain a pressure enough on the fork shaped prismatic part, in order to push the plug and allow, at the same time, said part to be rotated when the plug arrives at the end of the course.

So, it allows the rod to go on until arriving at its full—opening.

When the door returns to its rest position, the rod descends, and with it, the plug, the fork shaped prismatic part returning to its rest position, aided by the spring action.

The coin admission module is constituted, in turn, by the following elements, namely:

An acceding part for inserted coins.

A fixing part.

A ramp.

A pusher.

A drive assembly.

A plug.

The part acceding to the coins has a horizontal groove for inserting the true coins, the part providing an access to the coins relying on a flared entry, and a projection which facilitates said entry or admission operation.

The groove ends in a channeling, the lower side of which is configured by a curved surface of the part forming the ramp, and the upper side of which is formed by the ramp in the strict sense.

The coins, after being inserted in a horizontal position through the groove, slide on said curved surface, and after changing the direction, they run on the ramp toward the exit mouth of the channeling.

The fixing part is formed by a microfusion part made of steel, having an adequate thickness, with three studs welded on a face for fixing the ramp, and four drill holes for being bonded on the other face by means of other four studs to the part having the—groove.

This fixing part is flat at the face bonded to the part containing the groove.

On the face bonded to the ramp, it has a flat portion, and has a projecting volume having a parallelepiped shape to which its upper part has been rounded in order to facilitate the transition of the coins from a horizontal position of entry to a vertical position to be transferred to the interior of the ramp.

The ramp is made of drilled metal sheet to avoid frauds, and its final portion has a metal sheet tilting on a turning shaft—serving for closing the ramp, forcing the coins to come out vertically through the exit mouth, towards the coin validator.

If, owing to any cause, the coins or any other object would become blocked between the exit mouth and the entry to the coin validator, the part tilts on the shaft when the whole coin admission module is moved together with the telephone door, so that—said coins or objects do not impede the door of said telephone to be opened.

The turned part moves back to position by means of a spring coaxially mounted on the turning shaft.

At the upper side of the channeling via which the coins slide, there is a plate which serves as a cover for said upper part, and avoids the coins from going out of the channeling.

This plate acting as a cover, is fixed to the channel by means of a shaft, so being able to tilt if necessary to accede inside said channel.

Welded to the ramp, there is a partition which is parallel thereto, the function of which is to rigidify the assembly and impede a wire access inside the telephone through the holes of the own drilled sheet of the ramp.

The ramp is fixed to the fixing plate by means of three threated studs, welded to the own plate, and the whole coin admission module is fixed to the telephone entry by means of other four threaded—studs, arranged at the ramp ends and the front frame containing the groove, the telephone walls o machine where the assembly is installed.

The pusher is constituted by a cylindrical part with three different diameters, located at the front surface of the telephone or machine where it is installed, serving for driving the tilting lateral available in the coin selector.

The portion of greater diameter acts as a driving button for the whole assembly, and when pushed, it moves through a plastic bush, pushing a driving assembly that, tilting on a turning shaft mounted between two side walls fastened to the parallel partition of the ramp, allows a small wheel to push a lateral tilting arm of the movable partition of the coin selector and to attain the opening of said side partition.

The drive assembly is constituted by a metal sheet having a series of planes with different slopes, and resting on the medium diameter of the pusher, the less diameter portion of same passing through a wide hole on said sheet.

The drive assembly has other metal sheet formed also by a series of planes in different slopes, and at an end it carries incorporated the above-mentioned and described small wheel, which is fixed to said plate by means of a riveted pin.

Both metal sheets tilt on a common turning shaft and, so that their motion will be jointly shared, they are bonded by means of a screw and a nut.

In a concentric way with regard to the screw, and pressing between both metal sheets, a tensioning spring has been provided.

The assembly formed by the screw, the nut and the spring acts as an adjusting tensor for the drive assembly, vertically displacing the supporting point of the small wheel with the tilting arm of the coin selector, depending on whether the nut is threaded more or less on the screw.

In order that the drive assembly is in a rest position the metal sheet mentioned in the first place pressioning on the pusher, there is a coaxially mounted spring with the shaft against the—drive assembly, when the pusher is operated.

In order to avoid that, sometimes, the pusher will come out of the mentioned metal sheet, the pusher has at the final angle a threated zone for receiving a washer and a nut.

The plug, which is housed behind the own coin inserting module, is formed by a cylindrical pin having two different diameters, supported within a plastic bush, on which they also slide when it is vertically pushed by the pusher.

The cylindrical pin carries, at its lower end, a nut which acts as a supporting said contacting point for the pusher.

In order to aid the pin to return to an initial position, the plug carries a spring, arranged on said cylindrical pin and supported on the nut, which is compressed when the pin is pushed upwards.

BRIEF DESCRIPTION OF THE DRAWINGS

In order to complement the present description and aid to a better understanding of the characteristics of the invention, the accompanying drawings, in five sheets, which are a part of this specification, show in an illustrative but non limitative sense, the following.

DETAILED DESCRIPTION OF THE PREFERRED EMBODIMENT

Figure 1:
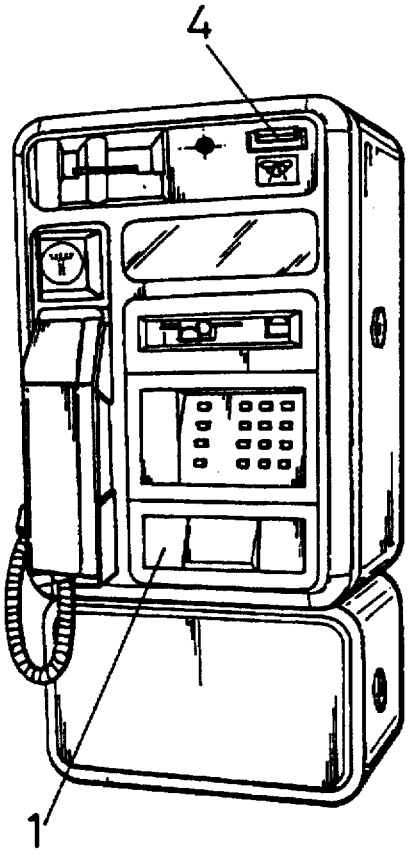
FIG. 1 shows a general view of a public modular telephone where the coin returning mechanism of the invention, is installed.
Figure 2:
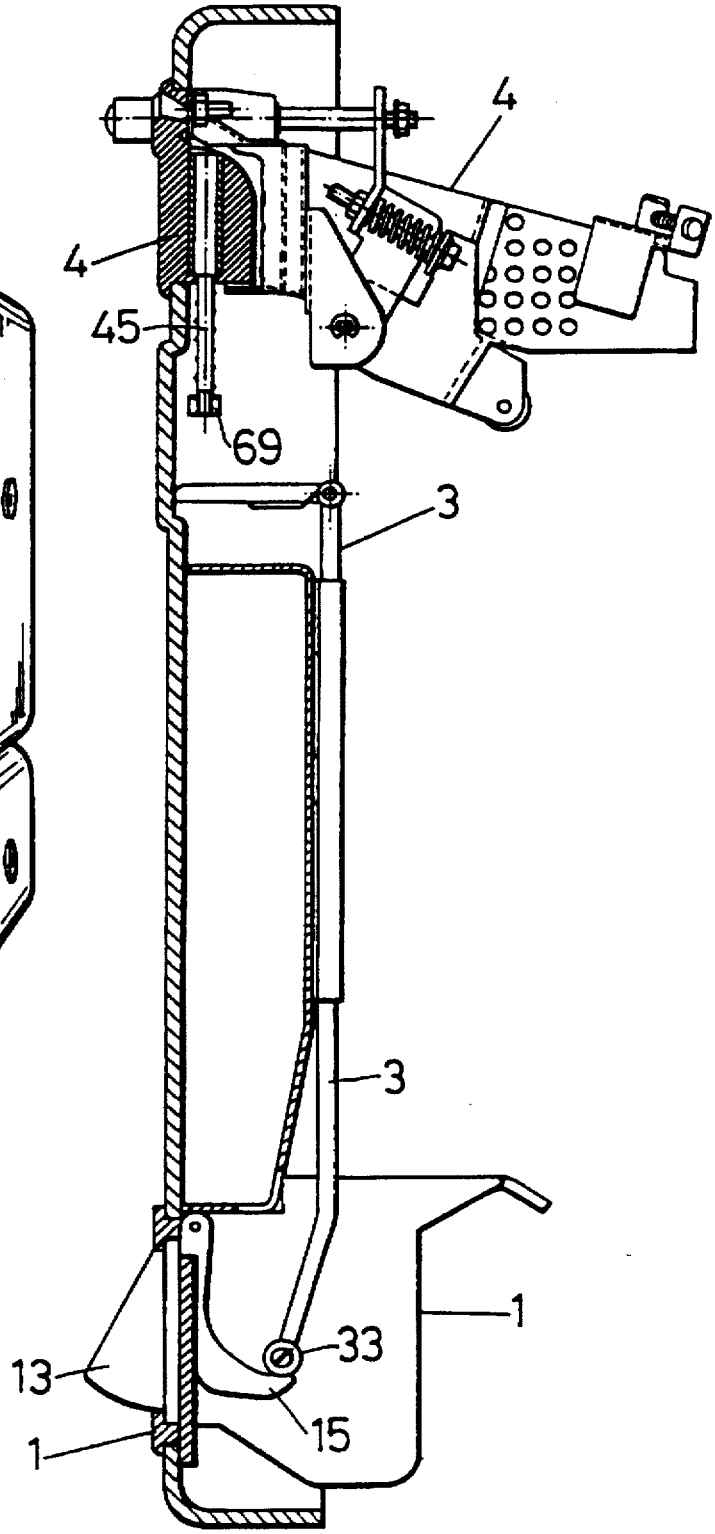
FIG. 2 shows an elevational section of said public telephone, showing the different parts or elements of the coin returning mechanism.

From the FIGS. 1 and 2, it can be seen how the coin returning mechanism or device, applicable to public modular telephones is constituted by three parts, which are configured as a coin returning box (1), a pusher (3), and a coin inserting module (4).

Figure 3:
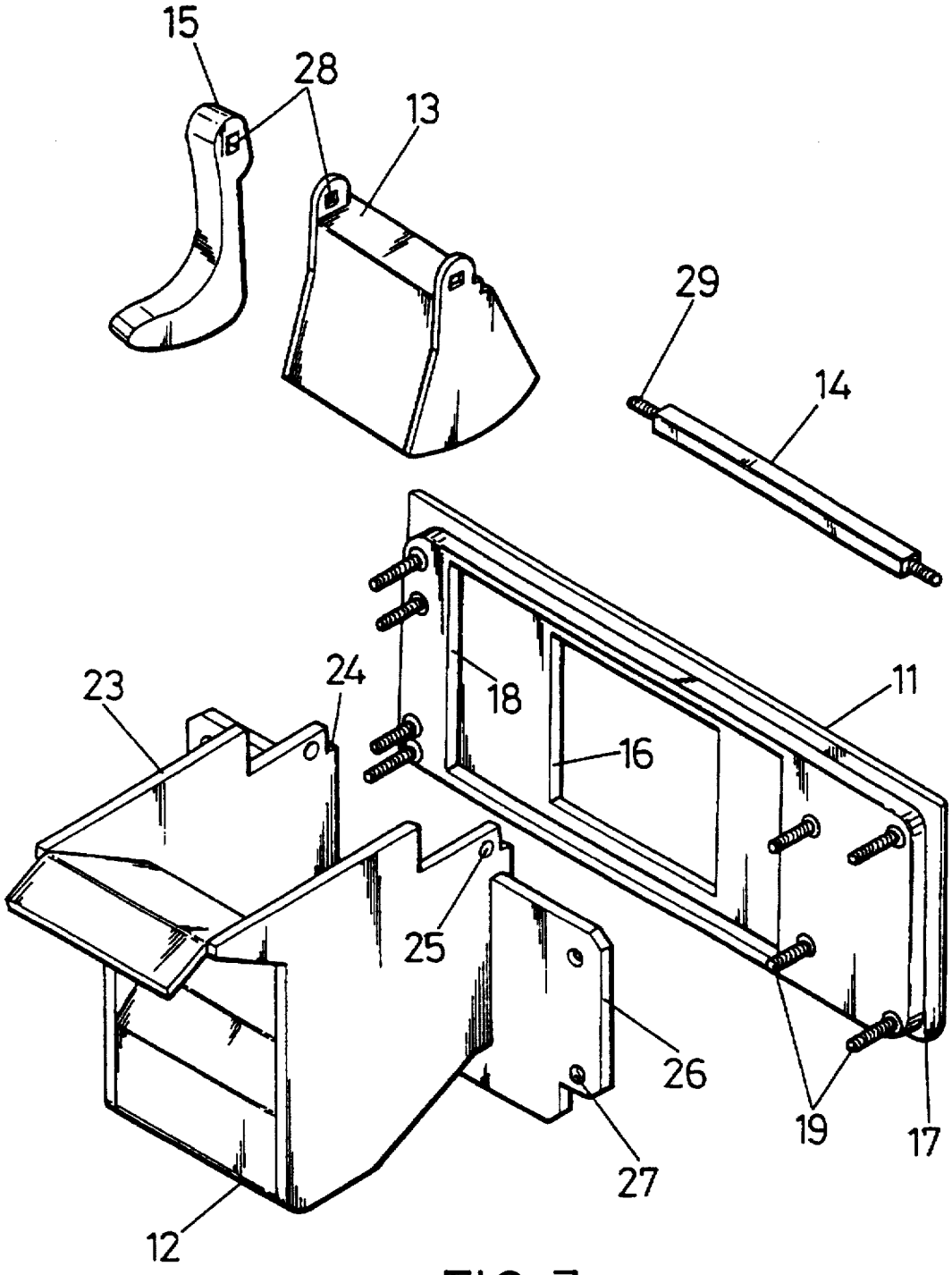
FIG. 3 corresponds to a general view wherein the five components forming the coin returning box are separately shown.
Figure 4:
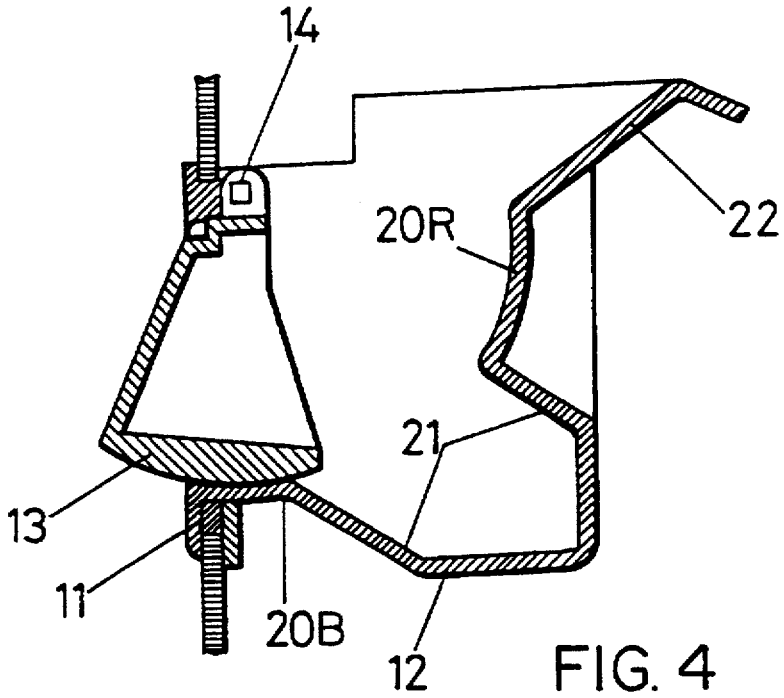
FIG. 4 corresponds to a section of the coin returning box in a plane which is perpendicular to the front frame thereof.
Figure 5:
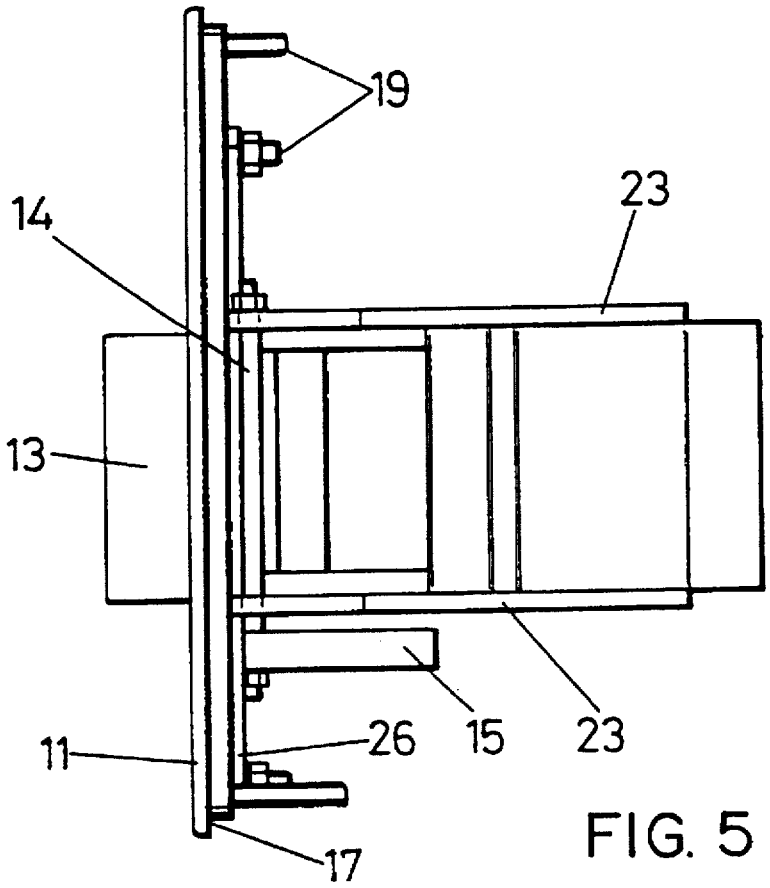
FIG. 5 shows an upper view of the coin returning box.

As seen in FIGS. 3, 4 and 5, the coin returning box (1) is—constituted, in turn, by five elements, which are configured as a front frame or panel (11), a coin receptacle (12), a door (13), a shaft (14), and a cam (15).

The front frame (11) is constituted by a rectangular prism of small height, and the base of this prism, seen from the outside of the machine where it is installed, exhibits a rectangular opening, centered in height and displaced toward the right end, which is closed by a door (13) acceding to the interior of the coin receptacle (12), the perimeter of this base being partially rounded.

The inner portion of the telephone or machine where it is installed, presents a perimetric recess (17) to be adapted to the opening cut on said telephone or machine.

Centered in height, but displaced toward the left side, there is a rectangular hollow (18) of less height than the perimetric recess (17) and with a width which is higher than the door opening (13).

It also exhibits two groups of four studs (19), located at the most end and destined for fixing the front frame (11) to the element in which it is installed, while that located at the most inner zone is designed for fixing the coin receptacle (12) to the front frame (11).

The coin receptacle (12) is configured as an irregular-shaped pan, fully open at its front and upper side, the function of which is to house the coins returned by the telephone or machine, so—that the users can recovered same.

The bottom and rear wall of said coin receptacle are constituted by two segments of circular surface 20B and 20R, adapted to the door configuration, and an open pentagonal profiled surface (21), serving as a pan for retaining the coins coming from the returning operation, so allowing the door (13) to be fully opened, tilting with no obstruction by returned coins.

The rear wall is completed by means of a ramp (22) formed by two planes, one of them, exactly the front one, being joined to the circular surface segment 20R, serving for transferring the returning coins to the pan (12), and other shorter rear plane.

The side walls are two flat surfaces (23), which are parallel and equal, having, at the upper part, two recesses (24), that located at the front portion being for adapting the coin receptacle (12) to the hollow (18) of the front frame (11), and the other one of greater dimensions is designed for allowing the adaptation to the inner configuration of the telephone or machine wherein it is installed.

On the step included between these two recesses, the side walls have cylindrical drill holes (25) faced one other, the function of which is to receive the shaft (14) supporting and tilting the door (13).

Joined to the side walls (23), in a direction perpendicular thereto, the invention has provided a part having a "U" configuration (26), the "U" arms having a width which is markedly larger than the portion joining them, and said arms have two cylindrical holes (27), each being coincidental with the set of four studs (19) located within the front frame (11), and serving for fixing to this frame the coin receptacle (12), catching the walls of the telephone or machine wherein the assembly is installed, between the "U" shaped part (26) and the front frame (11).

The door (13) of the coin returning box (1) is constituted, more or less, by a hollow cylindrical sector, formed by a curved metal sheet defining the main body of the door, and two side metal sheets closing the assembly by both sides, these side sheets having formed both square section drill holes (28), adjacent to the directrix of the cylindrical surface, where the shaft (14) is located.

At the portion of the cylindrical sector adjacent to the shaft (14), there are two recesses for fitting the door (13) in the front frame (11).

The side surfaces of the door (13) fit into the lateral sides of the rectangular opening (16) of the front frame (11) and the cylindrical surface thereof fits into the lower side of said opening (16) and the curved surface (20) constituting the bottom of the coin receptacle (12) in the rest position.

When the door (13) is tilted toward the interior, to accede to the returned coins, said cylindrical surface of the door (13) coincides with the cylindrical surface 20R of the rear wall of the coin receptacle (12).

The arc of the door cylindrical surface (13) is long enough for contacting the cylindrical surface (2) of the rear wall of—the coin receptacle (12), before interrupting the contact with the cylindrical surface 20B of the bottom thereof, thereby the access to the interior of the telephone, where the assembly is installed, is impeded all the time.

The shaft (14) is composed of a square section metal bar, the diagonal of which is equal to the diameter of the cylindrical holes (25) existing on the side walls (23) of the coin receptacle (12), and the side of which is equal to that of holes (28) existing on the cover (13) and the cam (15), where it fits for supporting and rotating these latter with them.

At both ends, the shaft has a threaded portion (29) to be fixed to the assembly by means of nuts.

The cam (15) is formed by a metal part, having an adequate shape, jointly moving with the cover (13), since it is mounted on an end of same shaft (14), out of the coin receptacle (12), the pusher—(3) assembly acting simultaneously by means of a small wheel (33) rolling on the surface of said cam (15).

Figure 6:
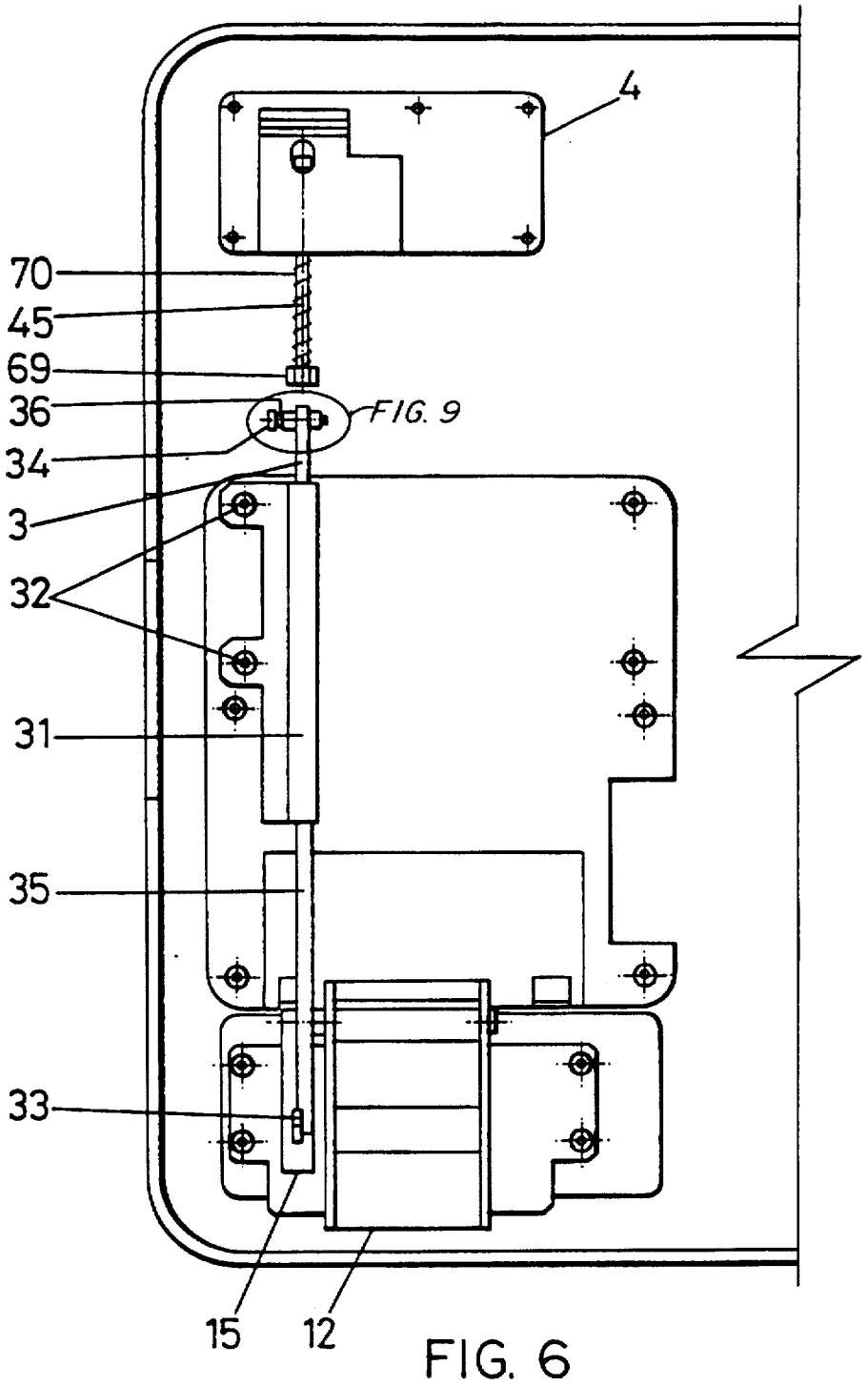
FIG. 6 shows a view of the interior of a public telephone in which it can be seen the pusher with its bracket.
Figure 9:
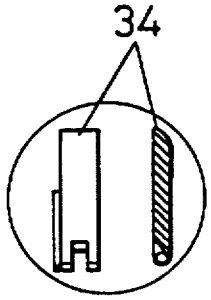
FIG. 9 shows a detail of FIG. 6.

As can be seen in FIG. 6, the pusher (3) is constituted, in turn, by a pusher bracket (31) and the own pusher (3).

The pusher bracket (31) if configured by a metallic rectangular part having both drill holes on one of the long sides of two wings, for fixing said part to the telephone, and at the opposite end it exhibits a "U"-shaped fold, on which the pusher (3) slides.

The bracket (31) is fastened to the interior of the telephone by means of two out of the studs serving as a support for the protecting plate of the display and the keyboard.

The pusher (3) is formed by a square section rod (35), one of its ends is folded, forming an angle of about 70°, such as shown in FIG. 2, having a recess for housing a small wheel (33) which is fastened to the rod (35) by means of a special screw, acting as a turning shaft.

At the other end, the rod (35) has a drill hole for placing in it a shaft supporting a prismatic part (34), having a fork shape, rotating about it.

This part (34), as seen in profile, ends curved at one of its ends, and has both transverse drill holes at the opposite end, through which the shaft passing through both fork arms (34) and the rod (35), passes.

Figure 7:
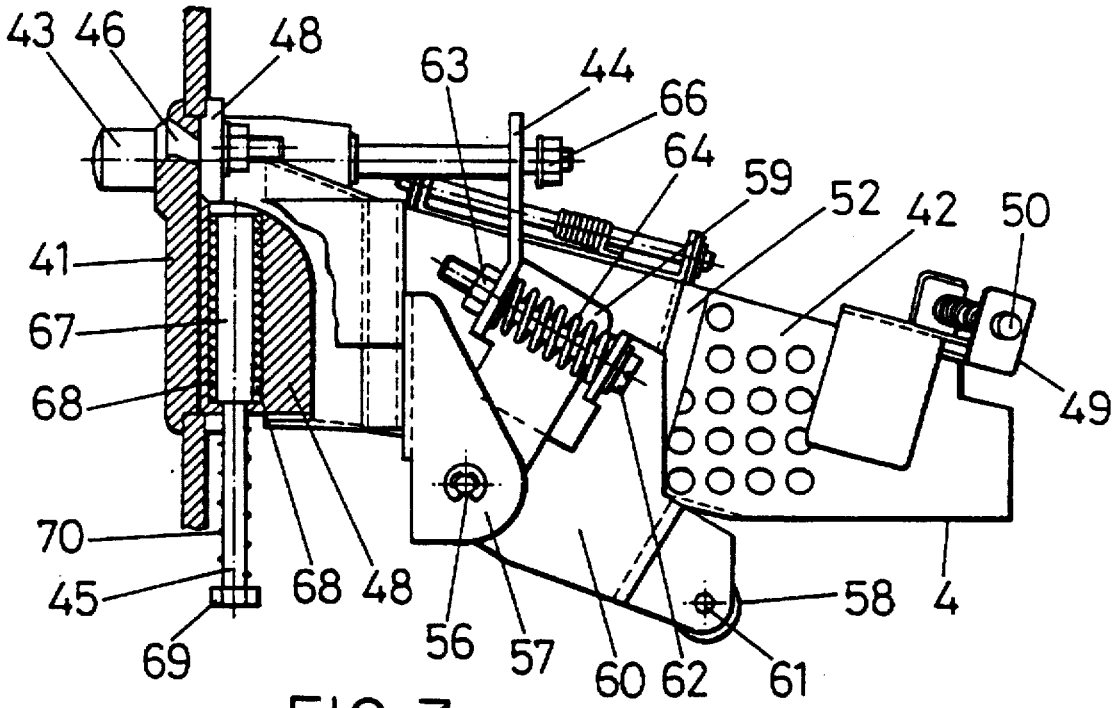
FIG. 7 corresponds to an elevational view of the coin inserting module.

The function of the part (34) is to push the plug (45) for impeding the coin admission through a groove (46), as seen in FIG. 7, when the rod (35) moves vertically upward driven by the cam (15), when the door (13) of the coin returning box (1) is opened to accede inside it.

In addition, the pusher assembly (3) has a spring (36) arranged about the shaft fastened to the rod (35) and the part (34), on which it exerts a pressure, and the function of which is to keep a—tension enough on the prismatic part having a fork shape (34) for pushing the plug (45) and facilitating, at the same time, the rotation of said part (34) when the plug (45) arrives at the end of its stroke.

In this way, its allows the rod (35) to continue its upward motion while the door (13) of the coin returning box is being opened (1) until reaching a full opening.

When the door (13) come back to its rest position, the rod (35) descends and, with it, the plug (45) also descends, the prismatic fork-shaped part (34) coming back to its rest position assisted by the spring (38) action.

Figure 8:
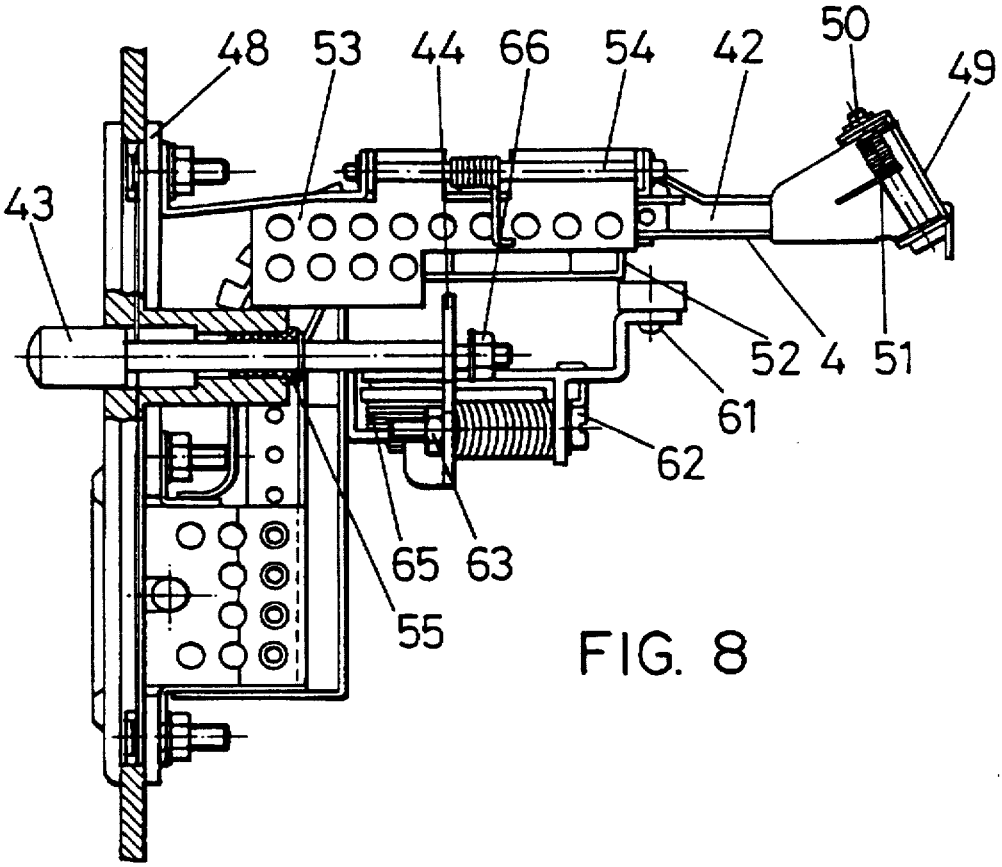
FIG. 8 shows lastly a plan view of the object illustrated in FIG. 7.

FIGS. 7 and 8 show how the coin inserting module (4) is constituted by a coin acceding element (41), a fixing part (48), a ramp (42) a pusher (43), a driving assembly (44), and a plug (45).

The element giving access to the coins (41) has a groove (46), in horizontal position, for receiving the coins via its flared—mouth, and a projection for making easy said operation.

The groove (46) ends in a channeling, the lower side of which is informed by a curved surface of the part containing the ramp (42), and the upper part of which is formed by the own ramp (42).

The coins, after being inserted in a horizontal position through the groove (48), slide along said curved surface, and, after changing the direction, they roll on the ramp (42) toward the channeling exit mouth.

The fixing part (48) is formed by a microfusion part made of—steel, having an adequate thickness, with three studs welded on a face for fixing the ramp (42), and four drill holes for being joined on the other face, by means other four studs, to the part containing the groove (41).

Said part (48) is flat on the face joining the part containing the groove (41), and on the face joining the ramp (42) has a flat portion and exhibits a projecting volume having a parallelepipedon shape, the upper part of which has been rounded in order to make easy the transferring of the coins from a horizontal admission position to a vertical position, to be transferred inside the ramp (42).

The ramp (42) is made of drilled metal sheet in order to avoid frauds, and at its end part has a metal sheet (49) tilting on a turning shaft (50) serving for closing the ramp (42), forcing the coins to vertically come out through the exit mouth toward the coin validator, not shown in Figures.

If, owing to any cause, the coins or any other object would become blocked between the exit mouth and the entry to the coin validator, the part (49) tilts on the shaft (50) when the whole—coin admission module (4) is moved together with the the telephone door, so that said coins or objects do not impede the door of the telephone or machine to be opened, where they are installed.

The turned part (49) moves back to its position by means of a spring (51) coaxially mounted on the turning shaft (50).

At the upper side of the channeling via which the coins slide, there is a plate (53) which serves as a cover for said upper part, and, at the same time, serves for avoiding the coins—from going out of the channeling (42).

This plate (53) is fastened to the channel (42) by means of a shaft (54) being able to tilt if necessary to accede inside said channel (42).

Welded to the ramp (42), there is a partition (52) which is parallel thereto, the function of which is to rigidify the assembly and impede a wire access inside the telephone through the holes of the own drilled sheet of the ramp (42).

The ramp (42) is fastened to the fixing part (48) by means of three threated studs, welded to the own plate, and the whole coin admission module (4) is fixed to the telephone door by means of other four threaded studs arranged at the ends, one of them being that fastens the ramp (42).

The pusher (43) is constituted by a cylindrical part with three different diameters, located at the front surface of the telephone or machine where it is installed.

This pusher (43) serves for driving the tilting lateral, available in the coin sector, not shown in Figures.

The portion of larger diameter operates as a driving button for the whole assembly, and when pushed, it moves through a plastic bushing (55), pushing the drive assembly (44) that, tilting on a turning shaft (56) mounted between two lateral walls (57), fastened to the partition (52), parallel to the ramp (42), allows a small wheel (58) to push a lateral tilting arm of the movable partition of the coin selector, and makes easy to open said lateral partition.

The drive assembly (44) is formed by a metal sheet (59) having a series of planes of different slopes, supported on the medium diameter of the pusher (43), the cylindrical part of less diameter thereof passing through a wide hole of said plate (59).

The drive assembly has other metal sheet (60) also formed by a series of planes in different slopes, and at an end it carries in corporated the above-mentioned small wheel (58), which is fastened to said plate by means of a riveted pin (61).

Both metal sheets (59, 60) tilt on a common turning shaft (56), and so that their motion will be jointly shared, they are bonded by means of a screw (62) and a nut (63).

Concentric to the screw (62), and pressing between both metal sheet (59, 60), there is a tensioning spring (64).

The assembly formed by the screw (62), the nut (63) and the—spring (64) act as an adjusting tensor for the drive assembly (44), by vertically displacing the support point of the small wheel (58) with the tilting arm of the coin selector, depending on whether the nut (68) is threaded, more or less, on the screw (62).

So that the drive assembly is in a rest position, the metal sheet (59) pressing on the pusher (43), it has been provided a spring (65), coaxially mounted on the shaft (56) against the drive assembly (44) when the pusher (43) is operated.

In order to impede that, in any situation, the pusher (43) would come out of the mentioned metal sheet (59), the pusher (43) has, at the final portion, a threaded zone for receiving a washing and a nut (66).

The plug (45), which is housed within the own coin inserting module (4), is formed by a cylindrical pin having two different diameters (67), being supported within a plastic bushing (68), on which they also slide when vertically pushed by the pusher (3).

The cylindrical pin (67) carries, at its lower end, a nut (69) serving as a supporting and contacting point for the pusher (3).

Lastly, in order to assist the cylindrical pin (67) to come back to its initial position, the plug (45) has a projection (70), arranged on said cylindrical pin (67), and supported on the nut (69), which is compressed when the pin is pushed upwards.

It is not considered necessary to extend more this description for an expert in the art to understand the scope of the invention and the advantages derived from it.

The materials, shape, size and arrangement of the elements are open to variation, provided that it does not imply any alteration to the essence of the invention.

The terms under which this specification have been described should be always taken in an ample and not limitative sense.

I claim:

1. A coin return mechanism especially useful for use in a pay telephone or other coin-operated device, the mechanism comprising:

a) a coin return box;

b) an access door for granting access to the coin return box;

c) a cam that moves integrally with the access door;

d) a square shaft on which the access door and cam rotate out of a rest position when the access door is pushed, and on which the access door and cam rotate into the rest position when the access door is not pushed;

e) a small wheel that rolls on the cam;

f) a prismatic part having fork arms;

g) a shaft that passes through the fork arms to support and rotate with the prismatic part;

h) a pusher including a square-section rod having a first end and a second end, wherein:

1) the first end is bent at a 70° angle and has a recess for supporting the small wheel and allowing the small wheel to roll on the cam; and 2) the second end has a hole for receiving the shaft and allowing the shaft to rotate;

i) a pusher bracket with a metallic rectangular part and two wings with two respective drilled holes for fixing the metallic rectangular part to the pay telephone or other coin-operated device, the pusher bracket including a "U"-shaped fold into which the square-section rod fits;

j) a spring, fastened between the prismatic part and the second end of the square-section rod; and k) a coin inserting module normally allowing insertion of a coin, but which insertion may be prevented through action of the access door and pusher acting on the coin inserting module.

2. The coin return mechanism of claim 1, wherein the coin inserting module includes:

front frame;

b) a coin-receiving slot, formed in the front frame and normally allowing insertion of a coin;

c) a ramp;

d) a fixing part, made of steel, for fixing the ramp to the from frame having the coin-receiving slot, the fixing part including:

1) a flat first face for joining with the front flame having the coin-receiving slot; and 2) a second face for joining with the ramp, the second face having a flat portion and a parallelepiped-shaped projecting volume, the upper part of the volume being rounded to allow coins to move from a horizontal orientation to a vertical orientation to allow the coins to be received by the ramp;

e) a push button;

f) a drive assembly, responsive to the push button; and g) a plug assembly, responsive to the pusher for preventing the insertion of the coin into the coin-receiving slot.

3. The coin return mechanism of claim 2, further comprising:

a turning shaft;

a tiltable metal sheet, rotatably disposed on the turning shaft when the coin inserting module is displaced together with a door of the pay telephone or other coin-operated device a coaxial spring, coaxially mounted on the turning shaft, and acting on the tiltable metal sheet;

a partition, welded to the ramp and parallel to the ramp;

a plate shape that is connected to the ramp;

a plate that is connected to the ramp via the plate shaft, and about which plate shaft the plate movably flits.

4. The coin return mechanism of claim 2, wherein the drive assembly includes:

a first metal sheet formed of a first series of planes, on a portion of the push button having a medium diameter, and having a wide hole through which passes a portion of the push button having a small diameter;

a second metal sheet formed of a second series of planes at respective slopes;

a rivet pin;

a small wheel that is rotatably connected to an end of the second metal sheet by the rivet pin;

a common turning shaft about which both the first and second metal sheets tilt;

a shaft spring that is mounted coaxially on the common turning shaft;

a screw and nut that fix the first and second metal sheets so that they move jointly in response to pushing of the push button;

a tensioning spring disposed coaxially with the screw, and pressing between the first and second metal sheets; and a washer and a nut disposed on a threaded portion of the push button to ensure that the driving assembly does not slip off the push button.

5. The coin return mechanism of claim 2, wherein the plug assembly includes:

a cylindrical pin;

a plastic bushing supporting the cylindrical pin and allowing the cylindrical pin to slide when the cylindrical pin is pushed through motion of the pusher;

a nut, disposed at a lower end of the cylindrical pin and receiving the motion of the pusher; and a spring, arranged on the cylindrical pin and supported by the nut, for normally urging the nut in the direction of the pusher.

* * * * *